United States Patent [19]

Hermann

[11] Patent Number: 4,901,408

[45] Date of Patent: Feb. 20, 1990

[54] MEANS FOR FASTENING SUSPENDERS TO A GARMENT OR OTHER ARTICLE OF CLOTHING

[76] Inventor: Sal Hermann, 5458 Claridge La., West Bloomfield, Mich. 48033

[21] Appl. No.: 206,830

[22] Filed: Jun. 15, 1988

[51] Int. Cl.[4] ..... A44B 21/00

[52] U.S. Cl. ..... 24/637; 24/495; 24/498

[58] Field of Search ..... 24/69 SK, 495–498, 24/503, 608, 631, 635, 637, 188, 179, 184, 265 BC, 708.1, 708.2, 708.3, 708.6

[56] References Cited

U.S. PATENT DOCUMENTS

| | | | |
|---|---|---|---|
| 527,887 | 10/1894 | Roth | 24/496 |
| 881,372 | 3/1908 | Buchanan | 24/503 X |
| 980,461 | 1/1911 | Walton | 24/708.2 |
| 1,007,206 | 10/1911 | Hubbard | 24/495 |
| 1,396,941 | 11/1921 | Pfeiffer | 24/498 |
| 3,757,389 | 9/1973 | Wiland | 24/708.6 |
| 4,463,482 | 8/1984 | Hawie | 24/498 X |

*Primary Examiner*—Laurie K. Cranmer

*Attorney, Agent, or Firm*—Lynn E. Cargill

[57] ABSTRACT

Disclosed is a fastener including a first and a second member, the first member having a post attached thereto extending toward said second member in a complementary relation, and the second member being connected to the first in a hinge-like relation, the second member having an opening therein for receiving the post attached to the first member. The post is attached to the first member in a complementary relation to the opening in the second member, such that when the suspender fastener is in a closed position the post remains attached to the first member, extends through the fabric of the garment being supported, and is received by the opening in the second member, whereby the fabric of the garment being supported is substantially held fixed. Furthermore, also disclosed is a reinforcement placed in the fabric of the garment to be held, such that the reinforcement is positioned intermediate the first and second members when in operation. The reinforcement has a sufficiently large opening for receiving and securing the post.

1 Claim, 1 Drawing Sheet

MEANS FOR FASTENING SUSPENDERS TO A GARMENT OR OTHER ARTICLE OF CLOTHING

TECHNICAL FIELD

This invention relates to an apparatus for fastening suspenders and the like to garments.

BACKGROUND OF INVENTION

Suspender fasteners have been known for many years, and many combinations of suspender fastener teeth, ribs, releasable clips, and other fastening devices have been utilized. Different configurations are used for different needs and purposes.

Conventional suspender fasteners are generally made of metallic or plastic plates, having teeth for engaging the fabric to be held. The teeth are generally of a configuration such that an attempt is made to minimize tearing or ripping of the fabric being held. In a conventional clip, a pivotal connection such as a spring or a clip joins the plurality of plates which comprise the suspender fastener. A first problem arises with these configurations because movement by the wearer of the garment inevitably causes tearing, or at least deformation of the fabric. In that regard, many inventions have been made which attempt to avoid sharp and tight teeth which would tear the fabric.

A second problem associated with conventional suspender fasteners includes slipping of the suspender fastener away from the fabric of the garment, which results in releasing of the fastener at unwanted moments. The suspender fastener must clamp securely to the garment so that movement by the wearer will not cause the suspender fastener to release.

In an attempt to solve such problems, U.S. Pat. No. 3,914,828 issued Oct. 28, 1975, to Noda discloses a clip having a plurality of projections and a resilient pad for receiving such projections. The projections clamp the fabric against the pad in order to secure the garment to the suspender.

U.S. Pat. No. 4,463,482 issued Aug. 7, 1984, to Hawie discloses a releasable compression fastener, such as a clip for use on a garter belt, suspenders or the like, including a pair of jaws comprising a base plate connected to a suspender strap and a means for clamping a layer of flexible fabric between cooperating, integrating jaws.

U.S Pat. No. 4,489,466 issued Dec. 25, 1984, to Bakker discloses a suspender fastener comprising a first lever, a second lever, and a ratchet. The first and second levers are pivotally connected and a pair of jaws on each of the first and second levers engages the garment therebetween.

An object of the present invention is to overcome the above mentioned problems by providing a suspender fastener which will withstand pressures due to movement by the wearer without releasing, tearing or deforming the fabric of the garment being supported.

Another object of the present invention is to provide a reinforcement for garments which will substantially reduce the tearing of the fabric in the garment when it is engaged by a suspender fastener.

Yet another object of the present invention is to provide an easily assembled and worn suspender fastener, and a suspender fastener which is capable of being easily manufactured.

These objects and advantages of the present invention will appear more fully in the detailed description of the drawings when read in combination with the drawings.

SUMMARY OF THE INVENTION

The present invention relates to an improved means for attaching suspender straps to a garment. More particularly, a releasable suspender fastener comprising first and second members is provided, the first member including a post attached to its surface adjacent to the surface of the second member facing the first member. The post may be of several configurations, including a rounded post, a post having an interlocking mechanism, or a post having a pointed or needle-like end.

Further, a reinforcement of the garment is included in the present invention and acts to receive the post and thereby support the garment. The reinforcement is placed in the fabric of a garment and is positioned intermediate the first and second members when in operation. The reinforcement has a sufficiently large opening for receiving the post therethrough. When the apparatus for fastening suspenders is in operation, the suspender fastener is closed, having the post which is attached thereto extending from the first member toward the second member. The second member has an opening therein for receiving the post, such that when the suspender fastener is in a closed position, the post remains attached to the first member, extends through the fabric of the garment being supported, and is received by the opening of the second member. The fabric of the garment being supported is thereby substantially held fixed, and substantially prevents the fastener from releasing from the garment. The first and second members of the suspender fastener may be connected in a hinge-like relation by a clip means, a spring means or a cam and lever design.

The post may include a columnar post having a substantially round diameter and a slightly rounded tip avoid injury to skin, clothing or other delicate articles potentially coming into contact with the end of the post. The post may also have a needle-like or conically shaped tip for penetrating fabric of a garment, with the post being of such a length that the needle-like or conically shaped tip of the post is received within the opening of the second member without extending beyond its outer surface so that the tip is shielded from contact with skin, clothing, etc. The first and second members may further include complementary male and female grippers to more evenly distribute forces.

The post may further include a releasably interlocking mechanism for securing the post within the second member when the suspender fastener is in a closed position. The interlocking mechanism may have a rounded end which is sufficiently small to fit through an opening in the fabric of the garment, yet sufficiently large that the opening in the second member will receive the post in the interlocking mechanism without allowing the rounded end of the post to extend past a predetermined location in the outer of the second member.

A reinforcement is described which is placed in the fabric to work in cooperation with the post attached to the first member to securely fasten the garment to the suspender fastener. The reinforcements may be grommets, eyelets, rivets or buttonholes.

Other embodiments may include at least two posts, to be used in conjunction with at least two reinforcements spaced apart in order to provide more support over a broader area of the fabric of the garment being supported. The posts would be distributed along the bottom surface of the first member of the suspender fastener in a side-by-side relation.

Figure 1:
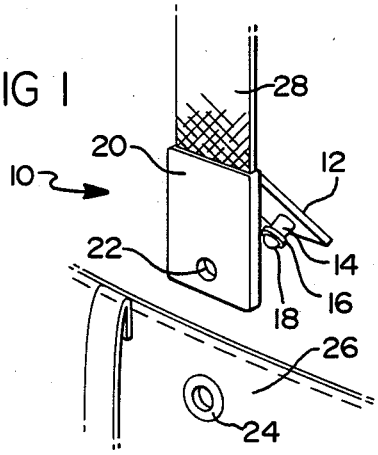
FIG. 1 is a perspective view of the suspender fastener before operation.

FIG. *2a* illustrates a side view of the suspender fastener showing the hinge means;

FIG. *2b* illustrates the suspender fastener in an open position;

FIG. *2c* is a cross-sectional side view of the fastener of FIG. 1 showing a spring means, the fastener being in an open position;

FIG. *2d* a cross-sectional view of the fastener of FIG. 1 shown pivotally connected by an actuating cam member, said fastener being in an open position; and FIG. *2e* is a side view showing an alternative embodiment.

DETAILED DESCRIPTION OF DRAWINGS

Referring first to FIG. 1, the present releasable suspender fastener, as generally denoted by 10, comprises a first member 12 and a second member 20 attached to each other. First member 12 includes a post 14 being permanently attached to its surface which faces the second member. Post 14 may include a rounded or needle-like tipped post or may be an interlocking mechanism 16 incorporated with a round end 18 which is received by second member 20 having an opening 22. An eyelet 24 may be placed within the fabric 26 of the garment to be supported. Post 14 extends through eyelet 24 and is received by opening 22 so that suspender fastener 10 will not become detached from garments 26. Suspender fastener 10 is attached to a suspender 28 which may be made of a belt, an elastic strap or the like. In operation, post 14 will extend through eyelet 24 and opening 22 such that interlocking mechanism 16 and rounded end 18 extend beyond the outer surface of second member 20.

Referring now to FIG. *2a*, the suspender fastener of FIG. 1 is shown in a closed position to indicate the relative placement of interlocking mechanisms 16, post 14 and rounded end 18 in relation to second member 20. Furthermore, first member 12 is illustrated as being attached to second member 20 in a hinge-like relation. Suspender 28 is attached to the top of the suspender fastener and secured within the suspender fastener itself.

In looking to FIG. *2b*, a suspender fastener having first and second members 12 and 20 includes a post 14 having a substantially conically shaped end 15 which is received in opening 22 for securing belt or strap 28 to a garment for support. First and second members 12 and 20 may be connected by a hinge means as illustrated in FIG. *2b*. Pointed tip 15 of post 14 is received within opening 22 without extending past the outer dimension of opening 22. The pointed end of the substantially conical shaped tip 15 of post 14 may be adapted for piercing fabric of a garment to be supported. Furthermore, the suspender fastener disclosed in FIG. *2b* may also be used with the reinforcement described in FIG. 1.

Referring now to FIG. *2c*, another embodiment including a releasable suspender fastener is illustrated comprising first and second members 32 and 30 respectively. First member 32 includes an attached post 34 which extends toward second member 30. First member 32 is pivotally connected to second member 30 by a spring mechanism 36. Post 34 is received by opening 38 in second member 30 and, when in closed position, extends through the fabric of a garment to be supported by the suspender fastener. Fabric 40 is a belt, band or the like attached to the suspender fastener. mechanisms known in the art will maintain the suspender fastener in a closed position. One of ordinary skill in the art would be able to use many conventional mechanisms and methods for maintaining the closed position.

Looking now to FIG. *2d*, there is illustrated a suspender fastener in accordance with the present invention having a first member 52 including a post 54, being pivotally connected to a first member 50 having an opening 58 to receive post 54. Actuating cam member 56 comprises a clamping plate, illustrated as first member 52, which is pivotally attached to a base plate, illustrated as second member 50, by means of opposed side projections which are confined within the opening inside piece 56. Actuating cam member 56 includes a depending cam section 60 which is designed to contact and depress the clamping plate, first member 52, when the handle portion of 60 is moved down against the backward surface of the first member 52. Such a depression causes post 54 to move towards opening 58 in a relatively parallel fashion. Suspender 62 is shown attached to the suspender fastener. The force of the actuating cam when handle 60 is in the closed position is sufficient to maintain the suspender fastener in a closed position, thereby supporting the garment.

In viewing FIG. *2e*, yet another embodiment of the present invention is illustrated. The suspender fastener has a first member 66 which includes a needle-like post 74 attached thereto. Furthermore, an attached female plate 82 is located adjacent to first member 66 which acts as a damping plate, facing a second member 64, and has the needle-like post 74 extending therethrough. Female plate 82 includes female indentations for receiving complementary protrusions of a male plate 80 attached to second member 64 to further secure the fabric of the garment being supported. Second member 64 further includes inwardly extending sidepieces 76 which have openings for receiving opposed side projections extending from an actuating cam member 70. Actuating cam member 70 is pivotally attached to a base plate, illustrated as second member 64, by means of opposed side projections which are confined within the openings in side piece 76. Actuating cam member 70 includes a depending cam section which is designed to contact and depress the clamping plate, first member 66, when the handle portion of 70 is moved down against the backward surface of first member 66. Such a depression causes post 74 to move towards an opening 78 in second member 64.

Figure 2A:
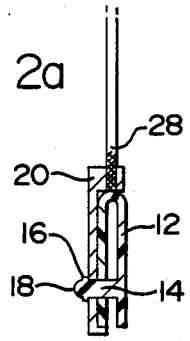
Figure 2B:
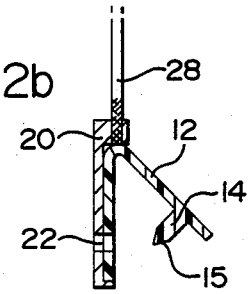
Figure 2C:
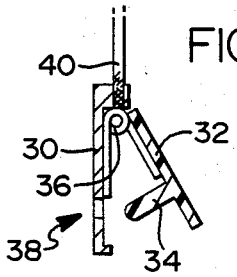
Figure 2D:
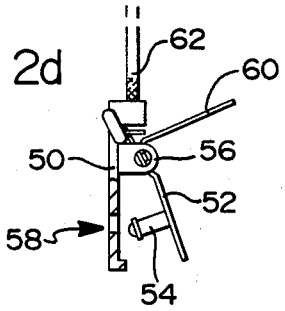
Figure 2E:
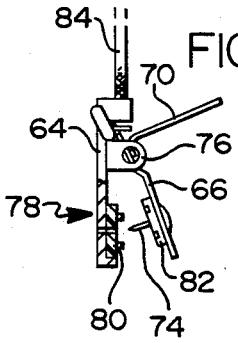

Also attached to second member 64 is piece 80 having male protrusions which are complementary to the female indentations in plate 82 of first member 66. The force of the actuating cam when handle 70 is in the closed position is sufficient to maintain the suspender fastener in a closed position, thereby supporting the garment. In order to further distribute the weight bearing portion of the suspender fastener, needle-like post 74 extends through the fabric of the garment to be supported, and the fabric is furthermore supported by the action of the two plates 80 and 82, respectively, with their male and female counterparts. The suspender fastener as illustrated in FIG. *2e* additionally illustrates suspender 84 in its attached position to the first member 64. Suspender 84 may be attached to the suspender fastener of FIG. 2*e* by any other reasonable attachment means.

It will be apparent to those skilled in the art, in the light of the present disclosure, that the present first and second members may be integral metal portions of the clamping plate and the base plate. However, such first and second members may be molded from a plastic composition, such as nylon, and may be a combination of plates, sections and members to form the suspender fastener.

It will also be understood, that while the form of the invention herein shown and described constitutes a preferred embodiment of the invention, it is not intended to illustrate all possible forms thereof. It will also be understood that the words used are words of description rather than limitation, and various changes may be made without departing from the spirit and scope of the invention.

What is claimed is:

1. Apparatus for fastening suspenders to a garment, comprising:

a fastener including a first and second member, said first member having a needle-like post attached thereto extending towards said second member in a complementary relation;

said second member being pivotally attached to the first member by means of opposed side projections which are confined within openings in attachments to the second member, said second member having an opening therein for receiving the needle-like post attached to the first member;

an actuating cam member including a clamping plate and a depending cam section lying adjacent to the first member, and pivotally attached to the second member by means of opposed side projections which are confined within the openings of the attachments to the second member, said actuating cam member exerting a sufficient force to maintain the suspender fastener in a closed position;

said first and second members having plates attached thereto on the surfaces facing one another, and said plates having complementary male and female portions which come together and cooperate when in a closed position; and said needle-like post being attached to the first member in a complementary relation to the opening in the second member, said opening extending through the plate attached to the second member, such that when the suspender fastener is in a closed position the post remains attached to the first member, extends through both the complementary plates, and further extends through the garment being supported, is received by the opening in the second member, whereby the fabric of the garment being supported is substantially held fixed.

* * * * *